United States Patent [19]

Baker et al.

[11] Patent Number: 4,826,166

[45] Date of Patent: May 2, 1989

[54] FOOTBALL TARGET ASSEMBLY

[76] Inventors: Richard M. Baker, Lot 56, Dandridge Golf & Country Club; Jeffrey L. Jones, P.O. Box 746, both of Dandridge, Tenn. 37725

[21] Appl. No.: 936,494

[22] Filed: Dec. 1, 1986

[51] Int. Cl.[4] ..... A63B 67/00

[52] U.S. Cl. ..... 273/55 R; 273/369; 273/400; 273/402; 273/407

[58] Field of Search ..... 273/55 R, 26 A, 16, 273/181 A, 402, 410, 401, 407, 26 B, 181 F, 184 R, 359, 362, 367, 369, 370, 374, 375, 382, 386, 390, 391, 392, 394, 402, 404, 407

[56] References Cited

U.S. PATENT DOCUMENTS

| | | | |
|---|---|---|---|
| 3,533,624 | 10/1970 | Miller et al. | 273/55 R |
| 3,573,867 | 4/1971 | Mehrens | 273/359 |
| 3,703,289 | 11/1972 | Hohman | 273/55 R |
| 3,823,939 | 7/1974 | Battorff | 273/55 R |
| 4,373,733 | 2/1983 | Smith, Jr. | 273/392 |

*Primary Examiner*—Richard C. Pinkham
*Assistant Examiner*—T. Brown
*Attorney, Agent, or Firm*—Pitts and Brittian

[57] ABSTRACT

A ball target assembly (10) for providing target practice and practice of timing in relation to the movement of a ball through the air. The device (10) comprises a frame section (12) positioned in a substantially upright position providing support for the device on the ground, a movable boom section (16) pivotally attached at the top and in front of the frame section (12) providing horizontal and vertical reciprocal movement of a ball receiver target section (66) to restore the target to a flush-upright position after being struck by a moving ball, a cable support system (85) providing support between the frame (12) and the target (66) so that the target (66) remains in the flush-upright position in a selected stationary position, and a backnet section (20) comprising a sack-oriented netting material received by the rearward portion of the frame (12) for timely collection and retrieval of the moving balls.

19 Claims, 3 Drawing Sheets

FOOTBALL TARGET ASSEMBLY

TECHNICAL FIELD

This invention relates to a unique, movable target device for providing target practice and practice of timing with respect to the movement of a ball through the air. While the invention will be described with respect to a football target backstop, it will be understood that the present invention has application to other sports requiring the throwing, snapping, passing or movement of an athletic ball.

BACKGROUND ART

There are a number of athletic backstop devices known to the art and related specifically to baseball or golf. Among such devices are those described by U.S. Pat. Nos. 4,497,485 to Macosko, 3,810,616 to Murphy, 3,698,712 to Pero, 3,197,208 to Makar, 2,978,246; to Gronigen, 2,895,737 to Blees, and 2,126,102 to Fowler. Most of these prior inventions have been intended for meeting special needs as presented by specific problems relative to the game of baseball or golf addressed in each of the prior inventions, and have, therefore, served narrow limited purposes.

For many years the state of the art method of developing football passing skills was to suspend a tire from a tree limb and throw through the center of the tire as it moved back and forth. Although this technique may have served some limited purpose, it did not provide the refinement necessary to efficiently and effectively develop a football player's skills. After a football player had thrown the football, it was necessary for that player to move to the site of the tire in order to steady the tire for the next throw. The interruption of the passing drill and the time necessary to move to the site of the tire in order to steady it for the next throw, was always necessary unless the tire was completely missed by the prior throw. In addition, it was necessary for the football player to also expend time and energy in finding the ball for the purpose of throwing it again. Such a procedure, involving the loss of time and energy, tended to limit the effectiveness of the practice technique by virtue of the fact that over two-thirds of the practice time was spent preparing to throw the football again. The present invention was conceived and designed to address these problems.

In utilizing the present invention for target practice passing, the football player or other game player may leave the target in a steady position (non-movable) and pass the ball at a rigid target zone. The football will be caught by the backnet provided in the present invention whether it goes through the target or not. In an alternate embodiment the target is provided with its own net section for easy retrieval of balls that have gone through the target. Therefore, the player is simply able to retrieve the football or other ball and prepare to throw again. In addition, it is an advantage of the present invention that the practicing player can throw at the target either straight away in alignment with the target or at a severe side angle. The side angle passing is not possible with the old tire method due to the width of the tire in relation to the size of the center target area. It is an additional advantage of the present invention that if the football strikes the target of the present invention as a result of being passed by the football player, the spring-loaded hinge, a part of the present invention, returns the target to its normal position for the next pass attempt, thus doing away with the necessity to move to the site of the target to steady the target for the next pass attempt. It is an additional advantage of the present invention that the target can be set into motion for timing practice, thus providing the football player or other practicing player with a moving target for the further development of the football passer's technique and timing or refinement of movement skills related to other games. It is therefore an object of the present invention to provide a football passing target apparatus which will economize time and energy in resetting the target means and collecting the footballs once they have been thrown.

A further object of the present invention is to refine the training process by allowing the football player or other player to concentrate his efforts on passing and timing as it relates to the act of actually passing the football or providing movement to another ball.

A still further object of the invention herein described is o provide a means of practicing passing or movement of a ball from acute angles on the practicing field.

Yet a further object of the invention is to provide a target which can be easily reset, and from which balls can be collected easily, for a center to practice snapping the ball to simulate a punting or kicking situation, thus providing long snap center practice or other types of practice for punting or kicking situations.

DISCLOSURE OF THE INVENTION

Other objects and advantages will be accomplished by the present invention which provides a football target assembly which can be used manually or automatically to position a stationary or moving target for providing target practice and practice of timing in relation to the movement of a ball through the air for simulation of game situations. The device is provided with a frame section which is positioned in a substantially upright position at a selected angle adopted to provide stable support and grip with the ground surface. The device is further provided with a movable boom section pivotally attached at the top and in front of the frame section. The boom section includes a support assembly means, a boom member, a ball receiver target section means and a cable support means, and provides horizontal and vertical reciprocal movement of the target to a flush-upright position after being struck by a moving ball. The cable support means provides support between the frame and the target so that the target remains in the flush-upright position in a selected stationary position after it has been struck by a moving ball, thus providing the advantage of not having to be reset after each throw when the ball strikes the boundaries of the target. The device is further provided with a backnet section including a sack-oriented netting material received by a rearward portion of the frame section for the timely collection and retrieval of balls that have been thrown at the target.

BRIEF DESCRIPTION OF THE DRAWINGS

The above-mentioned features of the invention will become more clearly understood from the following detailed description of the invention read together with the drawings in which.

BEST MODE FOR CARRYING OUT THE INVENTION

Figure 1:
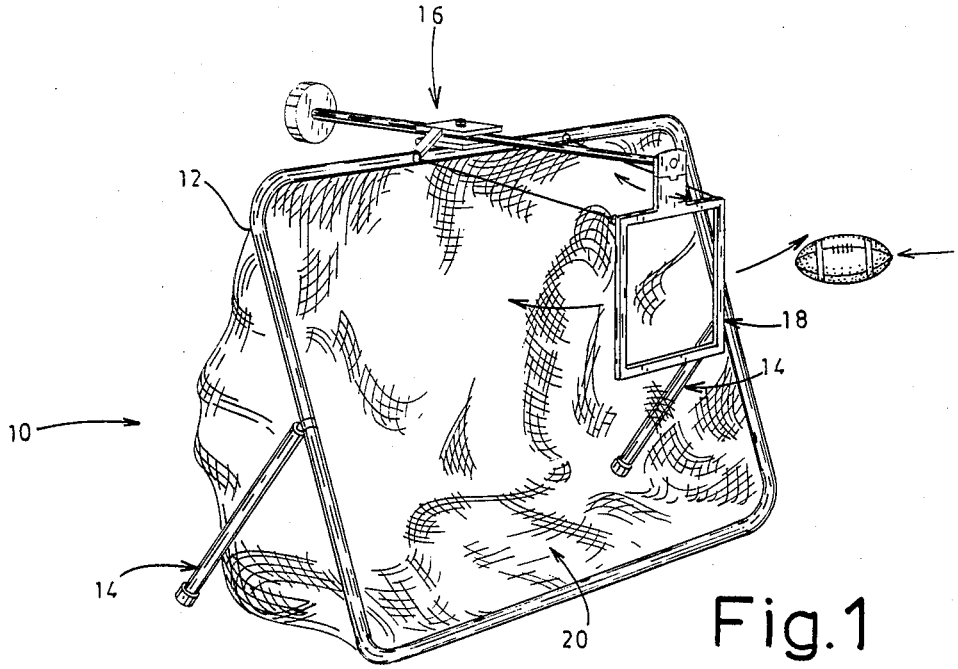
FIG. 1 illustrates a perspective view of the football target assembly in completely assembled position.

Referring now more particularly to the drawings, and to that embodiment of the invention here presented by way of illustration, FIG. 1 shows a football target assembly 10 having a tubular frame section 12, a support leg section 14, a pivotal boom section means 16, a target section means 18 and a net section 20.

Figure 2:
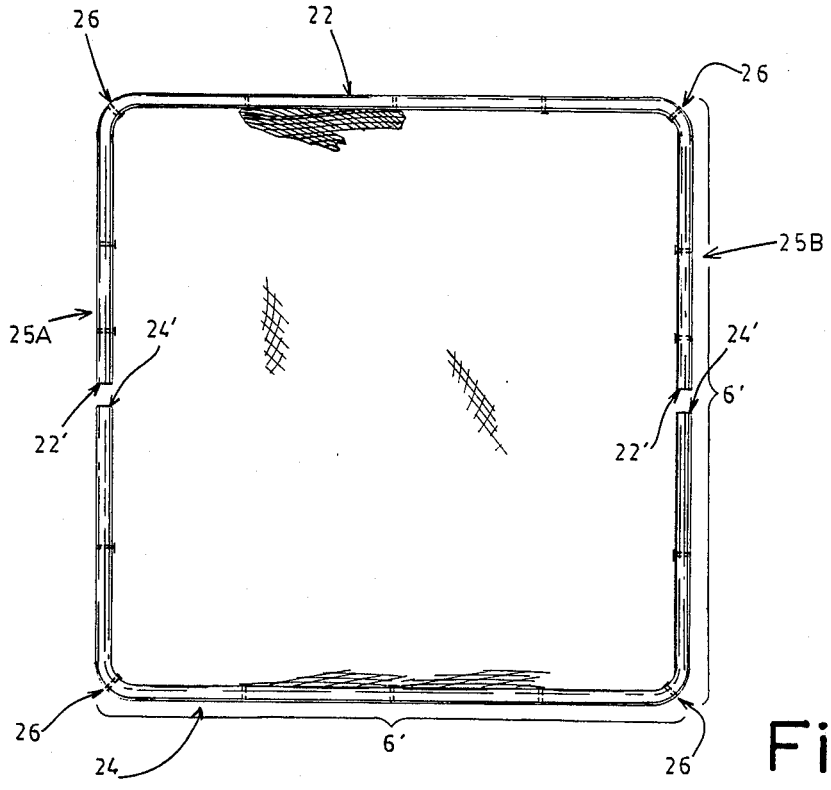
FIG. 2 illustrates a front elevational view of an upper tubular member and a lower tubular member comprising part of the frame section of the invention.

The tubular frame section 12, shown in FIGS. 1 and 2, is composed of two half-rectangular-shaped tubular members, an upper tubular member 22 and a lower tubular member 24, each of which is provided with two open ends 22' and 24', respectively, for reception of two connection bar stabilizers 15 described below. It is understood that the tubular members 22 and 24 can be either square or round tubing with an outside diameter approximately one and one-fourth inches with a wall thickness of approximately 0.083 inches [+ or −0.005] or any suitable dimensions representing standard production size; and that the tubular members can be constructed from stainless steel or chrome-plated steel or any durable construction material which is most economically feasible. The corners 26 (FIG. 2) of the frame section 12 can be squared or rounded in accordance with whatever shape is most economically feasible without compromising quality.

Figure 3:
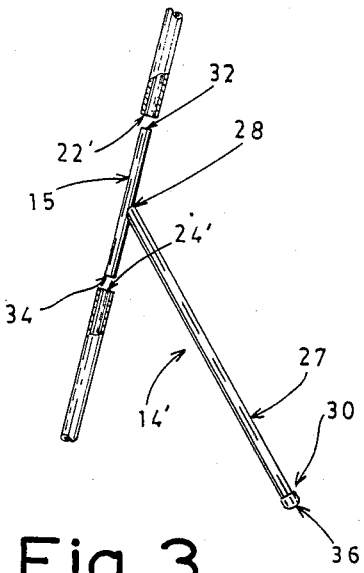
FIG. 3 illustrates a perspective view showing details of the support leg section and the integral connection with the frame section.
Figure 4:
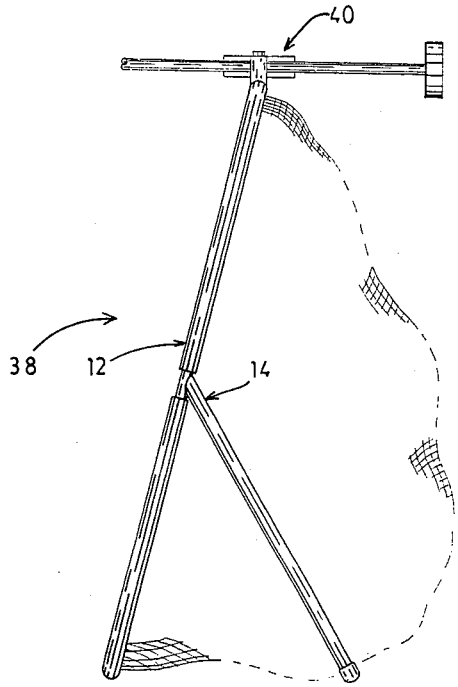
FIG. 4 illustrates a side elevation of the tubular frame section and the support leg section of the invention in assembled and erected position.

The support leg section 14 is composed of two leg members of the type shown generally at 14' in FIG. 3, and each leg member 14' is provided with a support shaft 27 which is provided with a forward most end 28 and a ground end 30. The forward end 28 is provided with the connection bar stabilizer 15 attached to the forward end at an angle $\theta$ of approximately 45 deg., but within a range of 30 deg. to 80 deg., and consistent with a stable, gripping ground placement of the ground end 30 (FIGS. 3 and 4). The connection bar 15 is provided with an upper end 32 and a lower end 34. In addition, the ground end 30 is provided with a protective cap 36 to assist in gripping the ground for stable placement.

The tubular member 22 is receptive at its two open ends 22' of the upper end 32 of each of the connector bar stabilizers 15, and the tubular member 24 is receptive at its two open ends 24' of the lower end 34 of each stabilizer 15; thereby providing the tubular frame section 12 with a first side perimeter 25A and a second side perimeter 25B.

The material employed in the construction of the tubular frame section 12 can be the same material employed in the construction of the support shafts 27 of the support leg system 14, or any strong durable hollow or solid material can be used in the construction of the support shafts 27. The connection bar stabilizers 15 can be hollow or solid and of virtually any feasible construction material so long as the strength of the support leg section 14 and the assembly 10 as a whole are not compromised.

It will be understood by those skilled in the art that the connection bar stabilizers 15 can be welded or attached by other secure means to the forward end 28 of the support shaft 27, and that the stabilizer 15 is to be securely fitted and attached at its upper end 32 and lower end 34 with the respective open end 22' and 24' of the tubular members 22 and 24 (FIG. 3), so as to fit securely in holding the tubular members to avoid any bending or play in the tubular frame section 12. A preferred posture for the connected tubular frame system 12 and support leg system 14 as described in relation to FIG. 3 is shown generally at 38 in FIG. 4.

It is understood that the material employed for the construction of the protective cap 36 or adoptive gripping means received by the ground end 30 of the support shaft 27 can be any non-skid resilient protective material which assists in holding the device 10 to the ground or surface of use.

Figure 5:
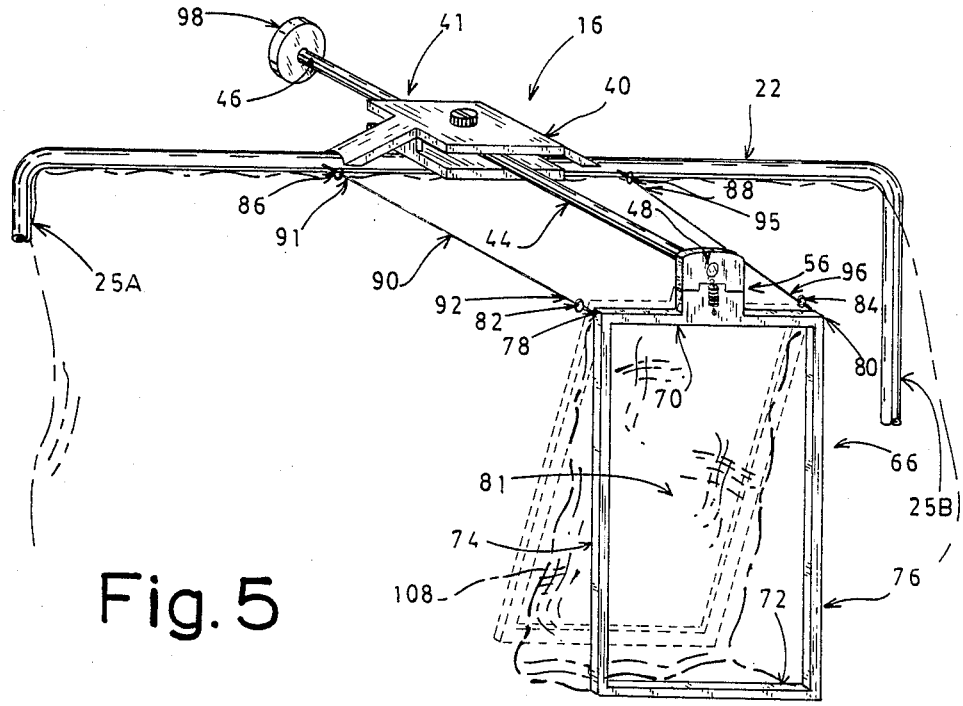
FIG. 5 illustrates a perspective view showing the details of the boom section and the target section of the invention.
Figure 6:
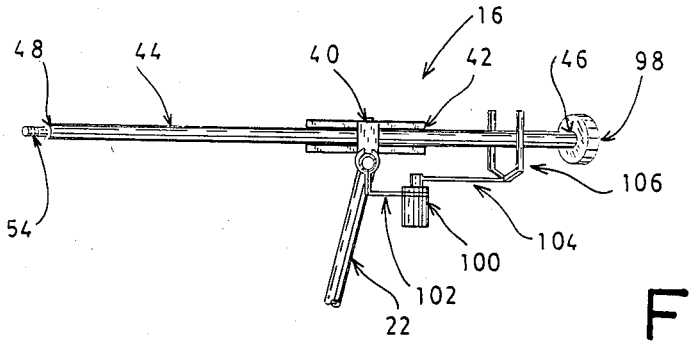
FIG. 6 illustrates a side view showing the details of the boom section and the drive means comprising a part thereof.
Figure 7:
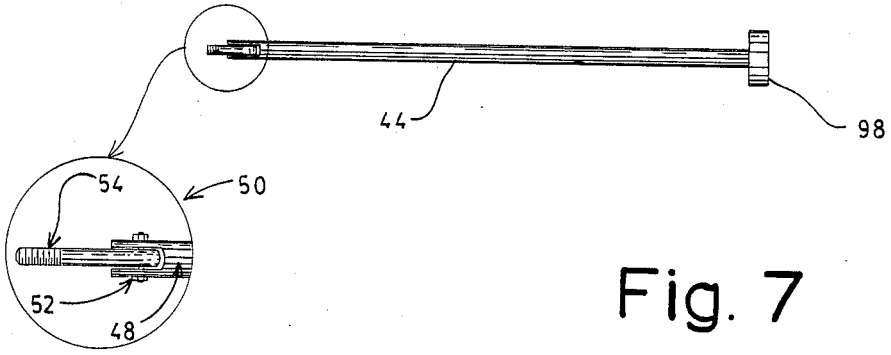
FIG. 7 illustrates an enlarged side view of the swivel assembly comprising part of the boom section of the invention.
Figure 8A:
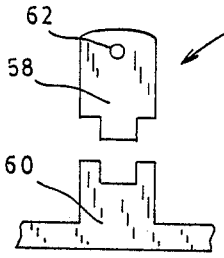
FIG. 8A is an enlarged detail frontal view showing the upper portion and the lower portion of the spring hinge assembly comprising part of the boom section of the invention.
Figure 8B:
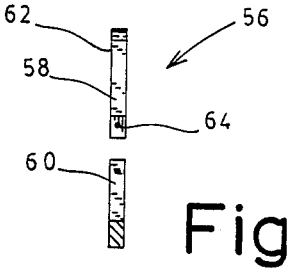
FIG. 8B is a side view showing the two portions of the spring hinge assembly illustrated in FIG. 8A.
Figure 8C:
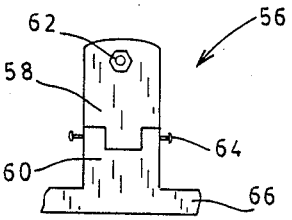
FIG. 8C is an enlarged detail frontal view showing the details of the spring hinge assembly.
Figure 8D:
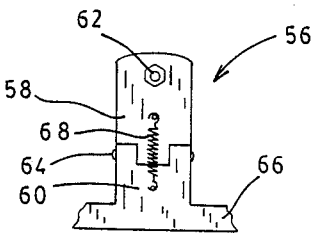
FIG. 8D is an enlarged detail frontal view showing further details of the spring hinge assembly.

The pivotal boom section means 16 is illustrated in FIGS. 5 and 6, and is provided with a support assembly means 40 which is attached to the upper tubular member 22 at a centrally disposed support assembly area. The support assembly 40 can be any suitable pivotal attachment element. The support assembly means 40 is provided with an aperture 42 which extends all the way through the assembly 40, and which receives a boom member 44 in specific fixed positions. It will be understood that the support assembly 40 is secured and adopted to secure the boom 44 to the frame 12 while permitting the boom a range of motion relative to the frame 12 equal to about 180 degrees. The boom 44 is provided with an inboard end 46 and an outboard end 48. The outboard end 48 of the boom 44 is provided with an end swivel assembly means 50 illustrated in FIG. 7 which consists of a pin hinge 52 which receives an end bolt 54. The swivel assembly 50 allows the target section 18 to turn. This will be discussed in greater detail below. It will be understood that the support assembly means 40 defines any of a number of pivotal attachment means for attaching a boom to a frame so as to allow the boom a wide pivotal range of motion up to about 180 degrees or more. It will also be understood that the swivel assembly means 50 can, be any acceptable hinge or movable, attachment element which would allow pivotal movement of the target section means 18 with respect to the boom 44.

By exemplar only, the material utilized in construction of the support assembly 40 can be a plate approximately 0.375 inches thick (±0.075) and can be stainless steel or chrome-plated steel. However, it will be recognized that many other types and specifications of materials can be employed, including standard production items, for the support assembly 40. It will also be understood that the support assembly 40 can be attached to the tubular member 22 of the frame 12 by welding into place and/or by other durable support and attachment means permitting a wide range of motion to the boom 44 as described above.

The boom section means 16 is further provided with a spring hinge assembly means 56 illustrated in FIGS. 5 and 8A through 8D. The spring hinge 56 is provided with an upper portion 58 and a lower portion 60. The upper portion, 58 is provided with a reception aperture 62. The aperture 62 is received by the end bolt 54 of the swivel assembly means 50 to hold the spring hinge assembly 56 in position on the boom 44. The lower portion 60 of the spring hinge 56 is attached to the target section means 18. In the preferred embodiment the target section means comprises a football receiver target 66 and the lower portion 60 of the spring hinge 56 is attached to the target 66. It will be understood that the target section means can be any appropriate target area consistent with the choice of game to be practiced. It will also be understood that the spring hinge assembly 56 is provided with a horizontally disposed pin hinge 64 to connect the upper portion 58 and the lower portion 60, and a vertically disposed return spring 68 which is attached to the spring hinge assembly so that the return spring extends from the upper portion 58 to the lower portion 60 and is attached in a position which allows the spring 68 to lay over the pin hinge 64. The return spring 68, is laid across the pin hinge 64 to provide stability for the receiver target 66 by returning the target 66 to the upright position. The spring hinge assembly means 56 will act in combination with the swivel assembly means 50 and elements of the target section 16 to be described below to keep the target 16 in a flush-upright position in the event that a ball moving towards the device 10 strikes the target 16. By exemplar only, the return spring 68 can be approximately three (3) inches long and five-eights of an inch in diameter, with sufficient resistance to assist the target 66 in returning to its upright position. It will be understood by those skilled in the art that the spring hinge assembly means 56 can be any acceptable hinge or movable biasing attachment element which would augment vertical reciprocal movement of the target section means 18.

The football receiver target 66 illustrated in FIG. 5 is a rectangular frame-like structure provided with an upper boundary 70 and a lower boundary 72 connected by a first side boundary 74 and a second side boundary 76, which together define a target area 81. As described generally above it will be understood that the lower portion 60 of the spring hinge is attached to the upper boundary 70 of the receiver target 66. In addition, the upper boundary 70 of the target 66 is provided with a first side-boundary end point 78 and a second side-boundary end point 80 at either end of the upper boundary 70 forming the area of connection with the first side boundary 74 and the second side boundary 76, respectively. The first boundary end point 78 receives a first eye-hook assembly 82, and the second boundary end point 80 receives a second eye-hook assembly 84. It will be understood that the eye-hook assemblies can be attached by a bored hole, weld or any other appropriately strong attachment means. It will be understood that the target 66 can be made of the same or similar material as that utilized in the construction of the tubular frame section 12, the boom 44 and the support leg section 14. It will also be recognized that the boundaries 70, 72, 74 and 76 of the target 66 can be rounded so long as the radius of each boundary does not significantly limit the target area 81.

The boom section means is also provided with a cable support means 85. It will be understood that the cable support means can be any cable or support attachment element providing biasing support between the frame 12 and the target 66. In the preferred embodiment, the upper tubular member 22 is provided at centrally disposed equidistant locations from the plate assembly area with a first upper tubular eye hook 86 and a second upper tubular eye hook 88 which can be attached as in the case of the eye hooks 82 and 84. The boom section 16 is provided with a first forward cable 90. The cable 90 is provided with an inboard end 91 and an outboard end 92. The inboard end 91 of the cable 90 is connected or attached to the first upper tubular eye hook 86 and the outboard end 92 is connected or attached to the first eye hook assembly 82. The boom section means 16 is also provided with a second forward cable 94 which is also provided with an inboard end 95 and an outboard end 96. The inboard end 95 of the second cable 94 is connected or attached to the second upper tubular eye hook 88 and the outboard end 96 is connected or attached to the second eye hook assembly 84. It will be understood that the first forward cable 90 and the second forward cable 94 will be parallel to each other and at equal distances from the boom 44. An exemplar distance off center of the upper tubular member 22 for the location of the two cables 90 and 94 would be nine (9) inches; but it will be understood that other functional distances consistent with the length of the upper boundary 70 of the target 66 can be employed. It will also be understood as described in part above that the cables 90 and 94 of the cable support means 85 will act to stabilize the target in a straight-forward or flush-upright position when a football or other ball thrown by a practicing player strikes any part of the target 66; and that the swivel assembly means 50 on the boom 44 will allow the target 66 to horizontally reciprocate in response to the pressure of the cables after responding to the pressure exerted on a target from being hit by a football or other ball. It will therefore be understood that the swivel assembly 50, the spring hinge assembly 56 and the cable support means 85 act in concert to provide horizontal-vertical reciprocal movement of the target so that the target returns to the flush-upright position after being hit by a ball; it will also be understood that these elements also function to present a flush-upright target 66 while it is moving (described below) or stationary. It is further understood that the cables 90 and 94 can be vinyl wrapped steel cables or any strong, resilient stabilizing or support means.

The boom section means 16 (FIGS. 5 and 6) is further provided with a balance weight 98. It will be understood that the weight 98 will function to counterbalance the fixed length of the boom 44 and weight of the target 66 determined at the time of manufacture of the target assembly 10.

The boom section means 16 is also provided with a power motor or drive means 100 shown in FIG. 6 which is attached to the upper tubular member 22 by a motor support frame 102. It will be understood that the support frame can be attached by weld or any other nonresilient attachment support means. The power motor is further provided with a forked rotating arm 104. The arm 104 is provided with a fork section 106 which extends a selected distance towards the inboard end 46 of the boom 44. It will be understood that the boom 44 passes through the fork section 106 thus allowing for vertical movement in the boom, and that the rotating arm 104 acts to move the boom 44 and the attached target 66 from side to side in an arcuate path with reference to the upper tubular member 22 therefore providing automatic movement of the target from side-to-side. It will also be understood as stated in part above, that the cables 90 and 94 will act in conjunction with the swivel assembly 50 and the spring hinge assembly 56 to hold the target 66 in a position parallel to the upper tubular member 22, therefore providing a totally exposed target area 81 so that the football passer or other person providing movement to a ball will have a parallel, flush-upright target to throw a football or other ball towards as the target moves from side to side along an arcuate path between the first side perimeter 25A and the second side perimeter 25B of the tubular frame section 12.

The power motor 100, by exemplar only, can be a small oscillating battery powered motor or alternately wind-up powered drive means sufficient to rotate the boom 44 and target 66 from side to side. However, it will be recognized that almost any drive means, including motors supplied by gas, or electrical power, could be employed to rotate the boom 44 and target 66. It will also be recognized that the motor support frame 102 can be weld mounted to the back of the frame 12 or tubular member 22 at a location determined by the size of the motor or drive means (100) itself.

It will also be understood that the target 66 and the boom 44 can be utilized in the invention in a stationary, manually controlled, non-movable manner so that the practicing player provides movement of a ball towards a pre-set stationary target 66, and the drive means 100 is not employed to provide movement to the target 66 as previously described.

In the use of the term "football" or "ball" it will be understood that a ball for use with the device 10 can be selected from a group of balls including, but not limited to, any elliptical-inflated ball, a spherical-inflated, ball or a spherical-hard/soft ball; and that the playing game situation to be simulated through the use of the device 10 can be selected from a group of games including, but not limited to, football, rugby, soccer, baseball, basketball, tennis, golf, or a combination of these games which may include passing, tossing, throwing, snapping, centering, kicking or otherwise providing movement to a ball to simulate a game or practice situation.

As described earlier, the tubular frame section 12, is provided with the net section 20. The net 20 comprises a nylon or metal/steel netting material which is constructed so as to have a midsection up to approximately three (3) feet deep with reference to the tubular frame section 12. It will be understood by those skilled in the art that the net 20 is attached to the frame section 12 so as to provide a collection backstop for footballs or other balls that are thrown at or placed in movement toward the target. By exemplar only, the net can be attached to the tubular members 22 and 24 by securing the netting 20 approximately every eight (8) inches. It will be recognized that many other means and forms of attachment of the net 20 can be utilized and that many different kinds of durable, resilient construction material can be utilized in the construction of the net 20 with varying and diverse depth specifications for entrapping the ball after passing, snapping or other movement of the ball for convenience of collection.

In an alternate embodiment of the invention, the target 66 is provided with an optional capture net 108 (shown in phantom lines in FIG. 5) which is attached to the rear portions of the boundaries 70, 72, 74 and 76 by Velco fastener or other conveniently removable means so that the net 108 can be taken off the target 66 for convenience when it is not desired or needed. The net material used in the construction of the capture net 108 can be any light resilient nylon, metal/steel alloy, or strong fabric.

By exemplar only, the dimensions of the constructed tubular frame section 12 can be approximately six (6) feet high and eight (8) feet from the first side perimeter 25A to the second side perimeter 25B. Also, by exemplar only, the dimeters of the football receiver target 66 can be approximately eighteen (18) inches from the first Side boundary 74 to the second side boundary 76 and approximately thirty-two inches from the lower boundary 72 to the upper boundary 70 of the target. It will be understood that various other dimensions can be employed in the construction of the tubular frame section 12 for the purpose of providing support and a narrower or broader base for entrapping the footballs or other balls that are thrown at the target 66, and that various other dimensions can be employed in the construction of the football receiver target 66 so as to appropriately and accurately simulate the general area on a real live football wide-receiver, tight end or running back that would be available to a football passer such as a quarterback in attempting to pass a football to such a receiver, a center in attempting to snap a ball to a kicker/punter or other player attempting to move a ball through the air to another player or location.

While a preferred embodiment has been shown and described, it will be understood that there is no intent to limit the invention to such disclosure, but rather it is intended to cover all modifications and alternate constructions falling within the spirit and scope of the invention as defined in the appended claims.

We claim:

1. A ball target assembly for providing target practice in relation to the movement of a ball directed through the air by a user, said ball target assembly comprising:

frame means having a top section, a lower section and opposite side sections, said frame means being supported upon a substantially horizontal support surface in a substantially upright position;

boom means, having a first end and a further end, pivotally attached to said top section of said frame means by a pivot means, said first end extending toward a user, said boom means being pivotally movable in a substantially horizontal plane substantially parallel to said support surface around said pivot means;

target means pivotally mounted on said first end of said boom means, said target means serving as a target for said movement of said ball through said air;

a further pivot means joining a top edge of said target means to said first end of said boom means, said further pivot means adapted for pivoting said target means about both a vertical axis and a horizontal axis with respect to said boom means;

means connected between said frame means and said target means for maintaining said top edge of said target means substantially parallel to said top section of said frame means during pivotal movement of said boom means; and net means supported from said frame means for collection and retrieval of said ball after said movement of said ball through said air relative to said target means.

2. The ball target assembly of claim 1 wherein said frame means comprises:

an upper tubular frame member and a lower tubular frame member attached to each other, each said upper frame member and said lower frame member having confronting first and second end portions, each provided with an axial passageway;

a first and a further junction member, said first junction member closely fitted within said passageway of said first end portion of said upper frame member and a corresponding passageway of said first end portion of said lower frame member, and said further junction member closely fitted within said passageway of said second end portion of said upper frame member and said corresponding passageway of said end portion of said lower frame member whereby said upper frame member and said lower frame member are joined;

a first leg member having a first end rigidly joined to said first junction member, and a second end for engaging a support surface; and a further leg member having a first end joined to said further junction member, and a second end for engaging a support surface, said first and further leg members providing for support of said frame means in said substantially upright position on said support surface.

3. The ball target assembly of claim 1 wherein said target means comprises an open target frame means defined by a top member, a bottom member and opposite side members; and said further pivot means comprises a first hinge unit mounted on said first end of said boom means, said first hinge unit having a bolt means pivotally connected to said first end of said boom means and pivotable about said vertical axis, and a second hinge unit mounted on said bolt means and attached to said top member of said open target frame means, said second hinge unit pivotable about said horizontal axis, said second hinge unit including biasing means whereby said open frame target means is normally biased into an upright position but said open frame target means can pivot about said horizontal axis upon being struck by said ball moving through said air.

4. The ball target assembly of claim 3 wherein said means for maintaining said top edge of said target means parallel to said top section of said frame means comprises:

a first and second attaching means on said top section of said frame means equispaced on opposite sides of said pivot means of said boom means;

a third and fourth attaching means attached to opposite ends of said top member of said open target frame means, spacing between said third and fourth attaching means being substantially equal to spacing between said first and second attaching means;

a first non-extensible tie member pivotally joined between said first attaching means and said third attaching means; and a second non-extensible tie member pivotally joined between said second attaching means and said fourth attaching means, whereby said top member of said open target frame means is maintained substantially parallel to said top section of said frame means as said boom means is pivoted around said boom pivot means.

5. The ball target assembly of claim 3 further comprising a further net means attached within said open target frame means for collecting and recovering balls striking said target means.

6. The ball target assembly of claim 2 wherein said second hinge unit comprises:

an upper hinge portion provided with an opening for receiving said bolt means of said first hinge unit;

a lower hinge portion pivotally attached to aid top member of said target means;

a substantially horizontal hinge pin joining said upper hinge portion to said lower hinge portion; and wherein said biasing means is a spring member having a first end attached to said upper hinge portion and a second end attached to said lower hinge portion.

7. The ball target assembly of claim 1 further comprising drive means connected between said top section of said frame means and said boom means for producing oscillatory pivoting motion of said boom means around said pivot means to reciprocatively move said target means across said frame means.

8. The ball target assembly of claim 7 wherein said drive means comprises:

motor means fixedly attached to said top section of said frame means;

rotary arm means attached to said motor means; and a fork section attached to said rotary arm means, said fork section embracing said boom means whereby rotation of said motor means causes said for section to produce said oscillatory pivoting motion of said boom means thereby moving said target means across said frame means in an oscillatory manner.

9. The ball target assembly of claim 8 wherein said fork section embraces said boom means between said further end and said pivot means, further said assembly comprising a weight attached to said further end of said boom means to counterweight said target means attached to said first end of said boom means.

10. A ball target assembly for providing target practice in relation to the movement of a ball directed through the air by a user, said ball target assembly comprising:

frame means having a top section, a lower section and opposite side sections said frame mean including leg members for supporting said frame means upon a substantially horizontal support surface in a substantially upright position;

boom means, having a first end and a further end, pivotally attached to said top section of said frame means by a pivot means, said first end extending toward said user, said boom means being pivotally movable in a substantially horizontal plane substantially parallel to said support surface around said pivot means on said top section of said frame means;

target means pivotally mounted on said first end of said boom means, said target means defined by a top member, a bottom member and opposite side members, and pivotable about both a vertical axis and a horizontal axis with respect to said boom means, said target serving as a target for said movement of said ball through said air;

hinge means connecting said top member of said target means to said first end of said boom means, said hinge means providing for said pivotable movement of said target means about said vertical and horizontal axes;

means connected between said top section of said frame means and said top member of said target means for maintaining said top member of said target means substantially parallel to said top section of said frame means during pivotal movement of said boom means; and net means supported from said frame means for collection and retrieval of said ball after said movement of said ball through said air relative to said target means.

11. The ball target assembly of claim 10 wherein said means for maintaining said top member of said target means parallel to said top section of said frame means comprises:

a first and a second pivotal attaching means on said top section of said frame means equispaced on opposite sides of said pivot means of said boom means;

a third and fourth pivotal attaching means attached to opposite ends of said top member of said target means, spacing between said third and fourth attaching means being substantially equal to spacing between said first and second attaching means;

a first non-extensible tie member joining said first attaching means to said third attaching means; and a second non-extensible tie member joining said second attaching means to said fourth attaching means;

whereby said top member of said target means is maintained substantially parallel to said top section of said frame means as said boom means is pivoted around said boom pivot means.

12. The ball target assembly of claim 10 wherein said hinge means comprises:

a first hinge unit mounted on said first end of said boom means, said first hinge unit having a bolt means pivotally connected to said first end of said boom means and adapted for pivoting about said vertical axis; and a second hinge unit mounted on said bolt means and attached to said open frame means, said second hinge unit adapted for pivoting about said horizontal axis, and a second hinge unit mounted on said bolt means and attached to said open frame means, said second hinge unit adapted for pivoting about said horizontal axis, said second hinge unit including biasing means whereby said open frame means is normally biased into an upright position by said open frame member can pivot about said horizontal axis upon being struck by said ball moving through said air.

13. The ball target assembly of claim 12 wherein said second hinge unit comprises:

an upper hinge portion provided with an opening for receiving said bolt means of said first hinge unit;

a lower hinge portion pivotally attached to said top member of said target means;

a substantially horizontal hinge pin joining said upper hinge portion to said lower hinge portion; and wherein said biasing means is a spring member having a first end attached to said upper hinge portion and a second end attached to said lower hinge portion.

14. The ball target assembly of claim 10 further comprising a further net means attached to said target means for collecting and recovering balls striking said target means.

15. The ball target assembly of claim 10 further comprising drive means connected between said top section of said frame means and said boom means for producing oscillatory pivoting motion of said boom means around said pivot means to reciprocatively move said target means across said frame means.

16. The ball target assembly of claim 15 wherein said drive means comprises:

motor means fixedly attached to said top section of said frame means;

rotary arm means attached to said motor means; and a fork section attached to said rotary arm means, said fork section embracing said boom means whereby rotation of said motor means causes said fork section to produce said oscillatory pivoting motion of said boom means thereby moving said target means across said frame means in an oscillatory manner.

17. The ball target assembly of claim 16 wherein said fork section embraces said boom means between said further end and said pivot means further said assembly comprising a weight attached to said further end of said boom means to counterweight said target means attached to said first end of said boom means.

18. The ball target assembly of claim 10 wherein said frame means comprises:

an inverted U-shaped upper frame member and a U-shaped lower frame member for cooperative attachment, each said upper frame member and said lower frame member having confronting first and second end portions, each provided with a passageway;

a first junction member closely fitted within said passageway of said first end portion of said upper frame member and a corresponding passageway of said first end portion of said lower frame member, and a second junction member closely fitted within said passageway of said second end portion of said upper frame member and a corresponding passageway of said second end portion of said lower frame member whereby said upper frame member and lower frame member are joined;

a first leg member having a first end rigidly joined to said first junction member, and a second end for engaging said support surface; and a further leg member having a first end rigidly joined to said second junction member, and a second end for engaging said support surface, said first and further leg members providing for said support of said frame means in said substantially upright position on said support surface.

19. A ball target assembly for providing target practice in relation to the movement of a ball directed through the air by a user, said ball target assembly comprising:

frame means having an inverted U-shaped upper frame member, a U-shaped lower frame member and junction member joining said upper frame member to said lower frame member, said junction members including leg members for supporting said upper and lower frame members in a substantially upright position on a substantially horizontal support surface;

boom means having a first end projecting from said frame means toward said user, and a further end, said boom means pivotally attached to said upper frame member by a pivot means and pivotally movable in a plane substantially parallel to said support surface around said boom pivot means;

a target means pivotally mounted on said first end of said boom means, said target means defined by a top member, a bottom member and opposite side members, said target means pivotable about both a vertical axis and a horizontal axis with respect to said boom means, said target means serving as a target for said movement of said ball through said air;

hinge means connecting said top member of said target means to said first end of said boom means, said hinge means providing for said pivotal movement around said vertical and horizontal axes, said hinge means including a first hinge unit attached to said first end of said boom means and having a bolt means for movement around said vertical axis, and a second hinge unit mounted on said bolt means and attached to said top member of said target means, said second hinge unit pivotable around said horizontal axis, said second hinge unit including biasing means whereby said target member is normally biased into an upright position but can pivot around said horizontal axis upon being struck by said ball;

means connected between said upper frame member on opposite sides from said pivot means and opposite ends of said top member of said target means whereby said top member of said target means is maintained substantially parallel to said upper frame member of said frame means during pivotal movement of said boom means, said means for maintaining said top member of said target means parallel to said upper frame member being as pair of non-extensible tie members each having as first end pivotally joined to said upper frame member and a second end pivotally joined to said top member of said target means; and net means supported from said upper and lower frame members for collection and retrieval of said ball after said movement of said ball through said air relative to said target means.

* * * * *